US005308271A

United States Patent [19]

Foulke

[11] Patent Number: 5,308,271

[45] Date of Patent: May 3, 1994

[54] NON-SLIP DESIGN PAD FOR SURFBOARD AND METHOD

[75] Inventor: Robert W. Foulke, San Clemente, Calif.

[73] Assignee: Q.P.I. Consumer Products Corporation, Tampa, Fla.

[21] Appl. No.: 943,743

[22] Filed: Sep. 11, 1992

[51] Int. Cl.[5] ..... B63B 35/79

[52] U.S. Cl. ..... 441/74; 4/583

[58] Field of Search ..... 441/74; 4/583

[56] References Cited

U.S. PATENT DOCUMENTS 3,999,224 12/1976 Kollsman ..... 4/583

4,285,082 8/1981 Cox ..... 441/74

*Primary Examiner*—Jesus D. Sotelo

*Attorney, Agent, or Firm*—Richard P. Crowley

[57] ABSTRACT

A non-slip foam design pad apparatus and method in which a design pad is adapted in a stretched condition for use on a surface, such as a surfboard, to provide a non-slip surface and to provide a selected design pattern on the surfboard. The design pad apparatus comprises a thin sheet of flexible foam material, a pressure-sensitive adhesive layer on one surface, and a removable protective layer over the pressure-sensitive adhesive layer. The foam sheet material is characterized by being diecut into a plurality of foam connected sections connected in a side to side alternating manner by short, uncut sections of the foam sheet material and adapted to move between a relaxed, diecut position and a stretched design position by longitudinal stretching of the non-slip design pad.

23 Claims, 2 Drawing Sheets

NON-SLIP DESIGN PAD FOR SURFBOARD AND METHOD

BACKGROUND OF THE INVENTION

Pads having a friction type, for example, non-slip surface thereon and having an adhesive layer on the other side are often employed, for example, in bathrooms to provide a non-slip surface to the tub surface. In addition, non-slip or friction type pads are often affixed by adhesive to watercraft surfaces to form a non-slip surface to prevent slipping of the user's feet or body. In watercraft such as surfboards, normally a wax coating is applied to the upper surface of the surfboard, which wax provides for a sticky, rough friction surface which retains the body of a surfer on the top surface of the surfboard, which wax layer is not affected by the water. In another embodiment, surfboards may have fixed friction pads secured to the top surface as a solid pad or layer.

It is desired to provide for a new, efficient non-slip design pad which is also adapted for use on a surface to provide a non-slip or friction type surface such as on watercraft and also to form a selected pleasing design pattern by the use of such a pad.

SUMMARY OF THE INVENTION

The invention relates to an friction design pad apparatus adapted for use on a watercraft surface to provide a non-slip surface and to form a selected design pattern on the surface.

The design pad apparatus comprises a thin sheet of a flexible foam material, such as, for example but not limited to, a polyethylene, such as a cross-linked polyethylene foam sheet material, which may be composed of the same or different colors, which foam sheet material has a friction type top surface. The top surface may be created by the employment of squares, grooves, or embossed patterns thereon. The foam material has a bottom surface and a longitudinal axis and sides. The apparatus includes a pressure-sensitive adhesive layer on the bottom surface of the thin foam sheet material, which adhesive layer is optionally, but preferably, covered by a removable adhesive protection layer, such as a piece of peelable paper to protect the pressure-sensitive adhesive layer prior to use, and which layer may easily be removed by peeling away the paper and adhering the pressure-sensitive adhesive layer to the desired surface.

The design pad apparatus includes a foam sheet material, which comprises a plurality of end-connected longitudinally arranged diecut sections of a particular and desired design, particularly of a wing design or like sections connected from side to side in an alternating manner by a short, undiecut section of the foam sheet material. The connection of each section is adapted to be along the longitudinal axis of the thin foam sheet material to permit the pad to be stretched longitudinally and to form a selected stretched design pattern, and also a non-slip surface on the surface to which the pad is adhered.

The method of the invention includes providing a friction or non-slip type surface to a selected surface of an object, such as a watercraft, such as, but not limited to, a surfboard, which comprises providing a longitudinally stretchable structural design pad apparatus comprised of a diecut, thin foam sheet material having a pressure-sensitive adhesive layer on one surface and an friction top surface; and longitudinally stretching connected diecut sections of the thin foam sheet material to provide spaces between the connected section to form a desired design pattern. The method includes removing the removable layer protecting a pressure-sensitive layer on the bottom surface, stretching and then securing the stretched design pattern pad apparatus in the stretched condition to the selected surface.

The foam design pad apparatus is referred to as being diecut which encompasses the preferred embodiment of employing a stamping die to stamp out or diecut a thin foam sheet material in a single, simple stamping operation. However, the foam sheet material may be cut or formed in other manners, such as separate sequential diecut operations, or by other cutting and forming techniques suitable for thin foam sheet materials.

The non-slip design pattern pad apparatus of the invention includes a thin foam sheet material, typically composed of a flexible foam material, such as, for example, any flexible foam material including olefinic material, urethane material, vinylchloride foam material and other foam material, but more particularly a polyethylene foam material, for example, a cross-linked polyethylene foam material which exhibits the desired degree of flexibility and toughness in use to be employed as a non-slip surface. Selected foam material may vary in foam density and generally ranges from as low as 2 pcf to as high as 12 pcf or more, and more typically ranges from about 4 to 8 pcf. The pad may be composed of different solid, or design type combination colors as desired to enhance the overall design features of the pad apparatus. Generally, the foam material may also vary in thickness and be as low as $\frac{1}{8}''$ to as high as $\frac{3}{4}''$, but more particularly ranges from about $\frac{1}{4}''$ to $\frac{5}{8}''$ in thickness.

The thin foam sheet material generally has a top and bottom surface with the top surface to be unadorned and umembossed or, if desired, may have a particular non-slip surface design thereon, such as by grooving a plurality of parallel grooves in the surface, or squares in the surface, or embossing the surface or otherwise treating the top surface to increase the foam surface area or to enhance the non-slip and friction characteristics of the top surface such, as by applying friction coating thereto.

The bottom surface of the thin foam sheet material includes an adhesive layer thereon, typically a pressure sensitive adhesive layer which is adequate to insure the permanent or semi-permanent adhesion of the bottom surface of the thin foam layer to the surface on which a non-slip surface and design is desired. Preferably, there is employed a removable sheet material on the top surface of the adhesive layer, such as a paper or other type sheet material, which is to protect the adhesive layer prior to use and which is easily removed just prior to use so that the adhesive layer may be secured to a surface.

The non-slip design pad apparatus may be employed on a variety of surfaces where it is desired to provide both a foam surface as well as a selected design thereto, and, in particular, is designed for use with watercraft, such as to include, but not be limited to, surfboards; body boards; water skis; sailboards; and the deck of sailboats. For example, the non-slip design pad apparatus may be employed for purposes of illustration in connection with a top surface of a surfboard, which has a polyurethane core and a polyester fiberglass outer shell surface on which the pressure-sensitive adhesive layer of the non-slip design pad is applied to the top surface of the surfboard.

The non-slip design pad apparatus of the invention comprises a thin foam sheet material which has been diecut into a selected design pattern, and typically diecut in a single diecut operation to provide for a plurality of diecut lines extending generally transverse across less than the total width of the foam sheet material to provide a plurality of connected foam sheet sections connected by alternating, side to side, uncut diecut sections of the foam sheet materials. In one example, the foam sheet material may be diecut to form a plurality of generally arcuate, generally parallel, diecut lines forming a plurality of multitudinally aligned wing or arcuate type shapes which are equally connected by the uncut thin foam material from side to side.

Optionally, or preferably, at the end of the diecut lines forming the connected sections there is a small hole at the end of every diecut from side to side to prevent the further tearing of the thin foam section along the diecut line. The diecut line terminates at the hole and defines the short, for example the uncut section, of the foam sheet material. In a further modification of the non-slip design pad apparatus one or more of the connected thin foam sections may also have one or more diecut sections within one or more of the connected sections, so as to provide greater design versatility to the design applied to the object surface. For example, the unconnected section may each have an arcuate wing type or other design diecut from the middle of the connected section to either be removed and discarded or used in connection with the stretched design.

The non-slip design pad apparatus of the invention thus permits the creation of an easy, effective preparation of a non-slip design pad, in a nonstretched or relaxed condition and thereafter permits the design pad to be stretched longitudinally to form a selected design either with or without the use of removable, punch-out diecut sections within the connected sections of the design, and all to be applied to an object's surface to form a foam, non-slip, friction type surface as well as a design on the object surface. The connected sections, as well as the diecut sections from the connected sections, may vary widely in form, shape and design to provide a variety of designs. The non-slip design pad may be employed, for example, on a surfboard or other object's surface alone or in combination with other non-slip surfaces or other design implementations on the surface.

Optionally, but preferably, in the diecutting of the foam design pad the diecut pad is retained in a unitary, nonstretched condition by leaving very short and partial sections of foam material uncut to retain the pad together prior to use; that is, removal of the back protective layer and stretching of the pad to the design portion. Typically, short ¼" to ⅛" foam sections are left undiecut and partially cut through at or toward the unconnected sides of each connected foam section to retain the connected foam section together, but which uncut retaining sections are easily broken away by the owner without damage to the design pad integrity. The means to retain the design pad in a unitary position may also be accomplished by the use of adhesives, short pieces of tape, clips or other removable retaining means.

The invention also comprises a combination of an object having a surface in combination with the stretched, adhered, applied non-slip design pattern on one or more surfaces of the object, such as, for example, a surfboard with a stretched foam design pad adhered to the top surface.

The invention will be described for the purposes of illustration only in connection with certain embodiments; however, it is recognized that various additions, changes, modifications, and improvements may be made on the illustrated embodiments all falling within the spirit and scope of the invention.

The invention is described as follows:

DESCRIPTION OF THE EMBODIMENTS

Figure 1:
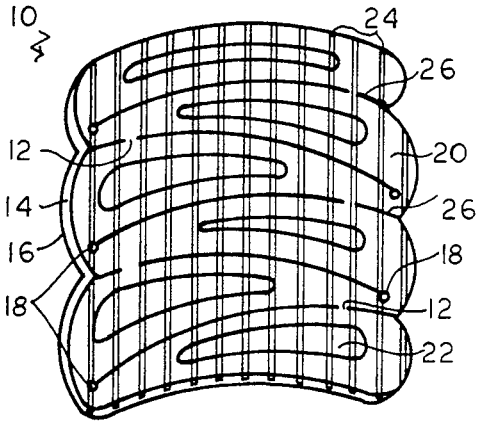
FIG. 1 is a perspective view from above of the non-slip design pad apparatus of the invention in a relaxed, non-stretched position.
Figure 2:
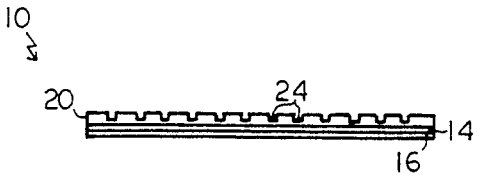
FIG. 2 is a side plan view of the non-slip design pad apparatus of FIG. 1.

FIG. 1 and FIG. 2 show the foam non-slip design pad apparatus 10 of the invention in a relaxed, diecut, non-stretched position comprised of a ¼" thick cross-linked polyethylene foam having a density of 5–6 pcf and having a thin pressure-sensitive adhesive layer 14 on the bottom surface thereon which is protected by a removable, peelable paper sheet 16. The design pad apparatus 10 then includes a plurality of arcuate transverse diecut lines 26 which form a plurality of arcuate shaped, rounded and connected foam sections 20 and contained within these sections a diecut section 22 which is subject to removal from the pad 10. Diecut lines 26 include at each end thereof a hole 18 to prevent the further tearing of the thin foam sheet material. The non-slip design pad apparatus is formed by a single diecut. However, the pad also contains in each connected section 20 a very small, foam retaining area 12 which has not been diecut to maintain the design pad in its unitary, relaxed, non-stretched condition as shown, and yet which sections may be easily overcome by longitudinal stretching of the connected sections 20 along the longitudinal axis of the design pad 10. The surface of the foam 20 contains a plurality of longitudinal grooves 24 in the foam surface to increase the surface area and to provide increased surface for traction. If desired, the grooves may also be placed transversely or with groove 24 to form a plurality of squares or rectangles in the top foam surface.

Figure 3:
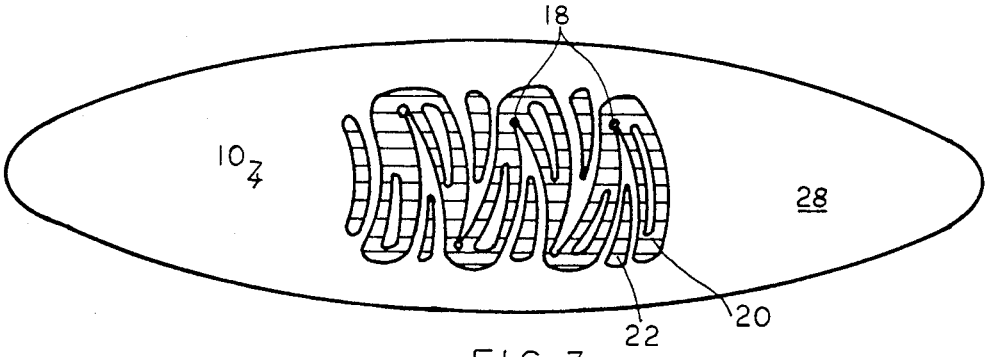
FIG. 3 is a plan view of a surfboard containing the non-slip design pad apparatus in a stretched condition.

FIG. 3 shows a surfboard 28 containing the non-slip design pad apparatus 10 in a longitudinally stretched design position, and secured through the pressure adhesive layer 14 to the top surface of the surfboard 28 in a selected design position. In the design position as illustrated, the arcuate rounded connected sections 20 are slightly stretched apart in an end connected manner and the removable design sections 22 have been removed from within the connected section 20, and then adhered through adhesive layer 14 in between the end connected sections 20 to form the design as shown.

Figure 4:
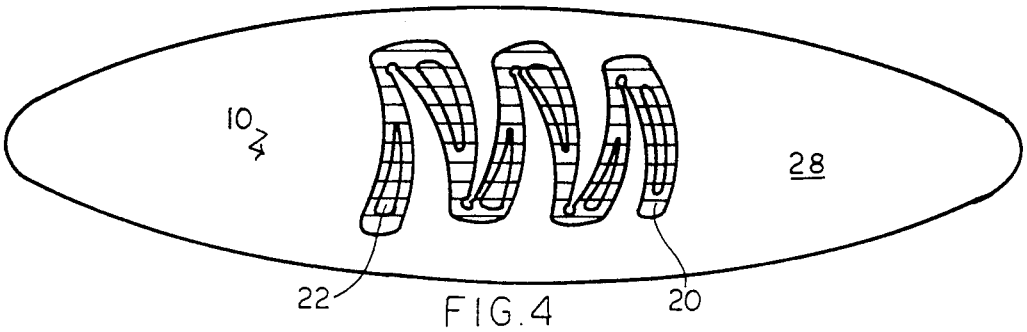
FIG. 4 is a top plan view of a surfboard containing the design pad apparatus of the invention of FIG. 1 in a stretched, different design position.

FIG. 4 shows the surfboard 28 with the top surface having a non-slip design pad apparatus 10 secured thereto; however, in this selected design embodiment, the diecut sections 22 have not been removed, but left in place and adhered to the surface of the surfboard 28.

Figure 5:
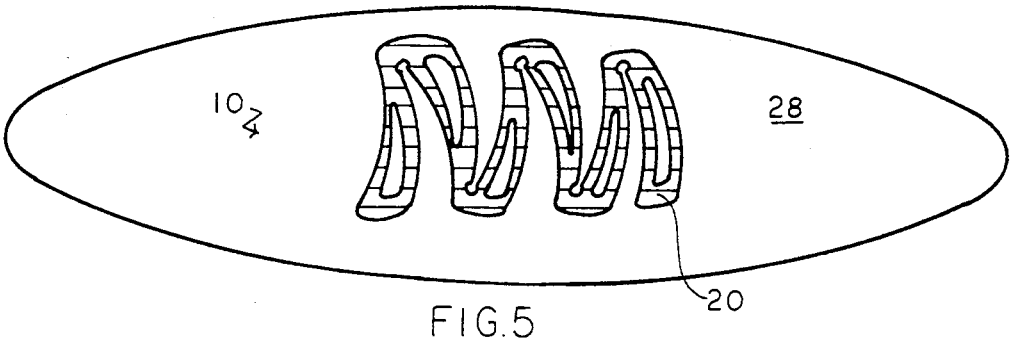
FIG. 5 is a top plan view of a surfboard containing the design pad of the invention of FIG. 1 in a stretched, different design position.

FIG. 5 shows a surfboard 28 with the non-slip design pad apparatus 10 of the invention in a stretched condition and with a different design wherein the diecut sections 22 have been removed but not re-used on the surface of the surfboard 28 and with the diecut sections left open.

Figure 6:
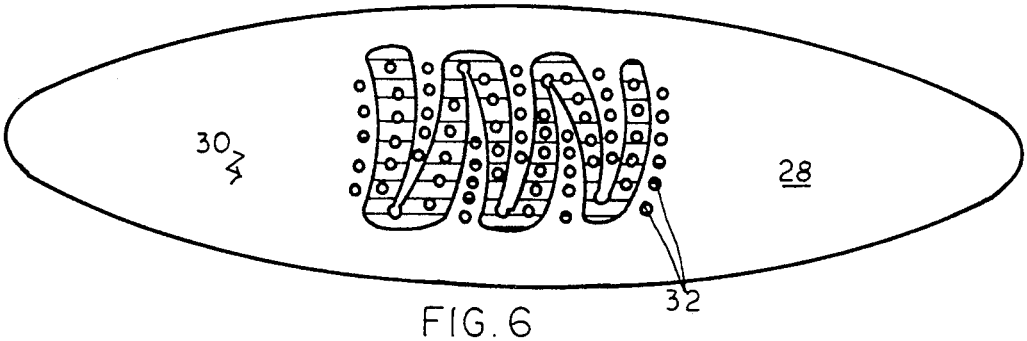
FIG. 6 is a top plan view of a surfboard containing another embodiment of a non-slip design pad apparatus of the invention in a stretched condition on a surfboard.

FIG. 6 is an illustration of a surfboard 28 having another different non-slip design pad apparatus 30 in a stretched condition and adhered to the surfboard 28. In this stretched design embodiment the connected sections are still arcuate sections 20, but the diecut sections 22 are in the form of circles 32 which have been removed from within sections 20 and adhered between the stretched sections 20.

As described and illustrated, the foam non-slip design pad apparatus and method provides for a non-slip foam surface on an object surface and also permits the formation of a different and selected design pattern thereon.

What is claimed is:

1. A design pad apparatus adapted for use on an object surface to provide a non-slip surface and a design pattern thereon, which design pad apparatus comprises:

a) a thin sheet of a flexible foam material having a non-skid foam top surface and a bottom surface and a longitudinal axis and sides;

b) a pressure-sensitive adhesive layer on the bottom surface of the foam material;

c) a removable adhesive protective layer on the pressure-sensitive adhesive layer; and d) the foam sheet material comprising a plurality of transverse connected diecut sections formed by diecut lines, the connected sections connected by short, uncut sections of the foam material on alternating sides of the foam sheet material, the connected sections adapted to be moved between a relaxed adjacent position and a stretched spaced-apart position along the longitudinal axis to form a selected design prior to being adhered by the pressure-sensitive adhesive layer to the object surface.

2. The apparatus of claim 1 wherein the connected diecut sections comprise generally parallel, arcuate sections on the longitudinal axis of the foam sheet material.

3. The apparatus of claim 2 wherein the connected sections are in the general form of a rounded wing section.

4. The apparatus of claim 1 wherein the connected sections include therein diecut removable sections.

5. The apparatus of claim 4 wherein the diecut, removable sections are in a general form of rounded wing sections.

6. In combination, an object having a surface and the stretched design pad apparatus of claim 4 secured by the pressure-sensitive layer to the surface of the object and with the removable diecut sections removed from the connected sections.

7. The combination of claim 6 wherein the removed diecut sections are secured by the pressure-sensitive layer to the surface of the object in surface spaces between alternating stretched connected sections.

8. The apparatus of claim 1 which includes holes at the end of the diecut lines which form the connected sections to prevent further extensions of the diecut lines in the foam material on longitudinal stretching of the foam material into the stretched position.

9. The apparatus of claim 1 wherein the foam material includes a contoured top surface on the foam sheet material.

10. The apparatus of claim 9 wherein the contoured surface is comprised of a plurality of grooves extending generally along the longitudinal axis of the foam material.

11. The apparatus of claim 1 wherein the foam sheet material comprises a cross-linked polyethylene foam sheet material having a thickness ranging from about $\frac{1}{8}''$ to $\frac{3}{4}''$ and a foam density of about 2 to 12 pcf.

12. The apparatus of claim 1 wherein the foam sheet material includes a user-removable means to retain the connected sections for a unitary design pad apparatus.

13. The apparatus of claim 12 wherein the removable means comprises un-diecut sections of the foam sheet material connecting the diecut unconnected sides of the connected sections together.

14. In combination an object having a surface and the stretched design pad apparatus of claim 1 secured by the pressure adhesive layer to the surface of the object.

15. The combination of claim 14 wherein the object comprises a surfboard with the design pad apparatus secured to the top surface.

16. A method of providing a foam non-slip surface and a design on the surface of an object, which method comprises:

a) providing a stretchable non-slip design pad apparatus of claim 1;

b) longitudinally stretching the connected sections of the design pad apparatus to provide spaces therebetween to form a selected design of the connected sections;

c) removing the protection layer from the pressure sensitive adhesive layer; and d) applying non-slip design pad apparatus with the pressure-sensitive adhesive layer in the desired stretched condition to the surface of the object.

17. The method of claim 16 which includes diecutting out a section within one or more of the connected sections of the non-slip design pad apparatus, and removing the diecut section prior to stretching and applying the non-slip design pad apparatus to the surface of the object.

18. The method of claim 17 which includes adhesively applying the removed diecut section to the surface of the object.

19. The method of claim 18 which includes adhesively applying the removed diecut sections to the surface of the object in surface spaces between alternating stretched connected sections.

20. An object having a foam, non-slip surface and design on the surface produced by the method of claim 16.

21. The method of claim 16 wherein the object comprises a watercraft having a surface.

22. The method of claim 21 wherein the object comprises a surfboard and the non-slip stretched design pad apparatus is applied to the top surface of the surfboard.

23. The method of claim 16 wherein the non-slip design pad apparatus includes a plurality of generally arcuate, rounded connected sections.

* * * * *